US009670555B2

(12) United States Patent
Okuno et al.

(10) Patent No.: US 9,670,555 B2
(45) Date of Patent: Jun. 6, 2017

(54) METHOD FOR PRODUCING A SUGAR CRYSTAL-CONTAINING LIQUID

(71) Applicant: MITSUI SUGAR CO., LTD., Tokyo (JP)

(72) Inventors: Masahiro Okuno, Tokyo (JP); Hisanori Nakajima, Tokyo (JP)

(73) Assignee: MITSUI SUGAR CO., LTD., Tokyo (JP)

( * ) Notice: Subject to any disclaimer, the term of this patent is extended or adjusted under 35 U.S.C. 154(b) by 0 days.

(21) Appl. No.: 14/901,298

(22) PCT Filed: Jun. 16, 2014

(86) PCT No.: PCT/JP2014/065900
§ 371 (c)(1),
(2) Date: Dec. 28, 2015

(87) PCT Pub. No.: WO2014/208386
PCT Pub. Date: Dec. 31, 2014

(65) Prior Publication Data

US 2016/0369358 A1 Dec. 22, 2016

(30) Foreign Application Priority Data

Jun. 28, 2013 (JP) ..... 2013-136069

(51) Int. Cl.
*C13B 30/02* (2011.01)
*C13K 1/10* (2006.01)
*C13K 13/00* (2006.01)

(52) U.S. Cl.
CPC ..... *C13B 30/02* (2013.01); *C13K 1/10* (2013.01); *C13K 13/00* (2013.01)

(58) Field of Classification Search
None
See application file for complete search history.

(56) References Cited

U.S. PATENT DOCUMENTS 3,972,725 A * 8/1976 Nicol ..... C13B 30/02 127/16
4,216,025 A 8/1980 Monti
(Continued)

FOREIGN PATENT DOCUMENTS

EP 0039123 A2 11/1981
EP 0039123 A3 11/1981
(Continued)

OTHER PUBLICATIONS

English translation of International Preliminary Report on Patentability and Written Opinion issued Dec. 29, 2015, in PCT International Application No. PCT/JP2014/065900.
(Continued)

*Primary Examiner* — Melvin C Mayes
*Assistant Examiner* — Stefanie Cohen
(74) *Attorney, Agent, or Firm* — Birch, Stewart, Kolasch & Birch, LLP

(57) ABSTRACT

PURPOSE: An object of the present invention is to provide a method for producing a sugar crystal-containing liquid with good reproducibility, wherein crystallization is enhanced, it is unnecessary to add seed crystals which may affect the number of grains and a size of the crystals, and graining conditions are stable.
CONSTITUTION: The present invention is a method for producing a sugar crystal-containing liquid, wherein the method comprises steps of preparing a liquid supersaturated with sugar; and applying a shearing force to the liquid, characterized in that the step of applying the shearing force comprises exerting a pressure higher than atmospheric pressure on the liquid to make the liquid pass through a narrow space.

4 Claims, 4 Drawing Sheets

Photographs with a microscope of a sucrose crystal-containing liquid

(56) References Cited

U.S. PATENT DOCUMENTS

| | | | | |
|---|---|---|---|---|
| 4,342,603 | A | 8/1982 | Daniels | |
| 4,640,717 | A | 2/1987 | Shukla et al. | |
| 4,666,527 | A | 5/1987 | Ito et al. | |
| 4,816,079 | A | 3/1989 | Ahrens et al. | |
| 5,989,351 | A | 11/1999 | Mizutani et al. | |
| 2012/0127823 | A1* | 5/2012 | Nakach ..... | C04B 35/584 366/176.3 |

FOREIGN PATENT DOCUMENTS

| | | | |
|---|---|---|---|
| EP | 0156596 | A2 | 10/1985 |
| EP | 0156596 | A3 | 10/1985 |
| JP | 56-137900 | A | 10/1981 |
| JP | 60-118200 | A | 6/1985 |
| JP | 60-256399 | A | 12/1985 |
| JP | 63-100995 | A | 5/1988 |
| JP | 1-266104 | A | 10/1989 |
| JP | 8-298927 | A | 11/1996 |
| JP | 2010-86859 | A | 4/2010 |
| JP | 2012-239422 | A | 12/2012 |
| JP | 2013-5790 | A | 1/2013 |
| WO | WO 2012/108293 | A1 | 8/2012 |

OTHER PUBLICATIONS

International Search Report, issued in PCT/JP2014/065900, dated Sep. 9, 2014.

Written Opinion of the International Searching Authority, issued in PCT/JP2014/065900, dated Sep. 9, 2014.

Database WPI, Week 200875, Thomson Scientific, London, GB, AN 2008-M66090, XP-002767215, & CN 101 239 996 A, Aug. 13, 2008, abstract.

European Patent Office Communication and extended search report issued in the corresponding European Patent Application No. 14817741.3 on Feb. 23, 2017.

* cited by examiner

Photograph with a microscope of an isomaltulose crystal-containing liquid

After 1 pass with 30 MPa (450 maginifications)

Fig. 3 Photographs with a microscope of a sucrose crystal-containing liquid
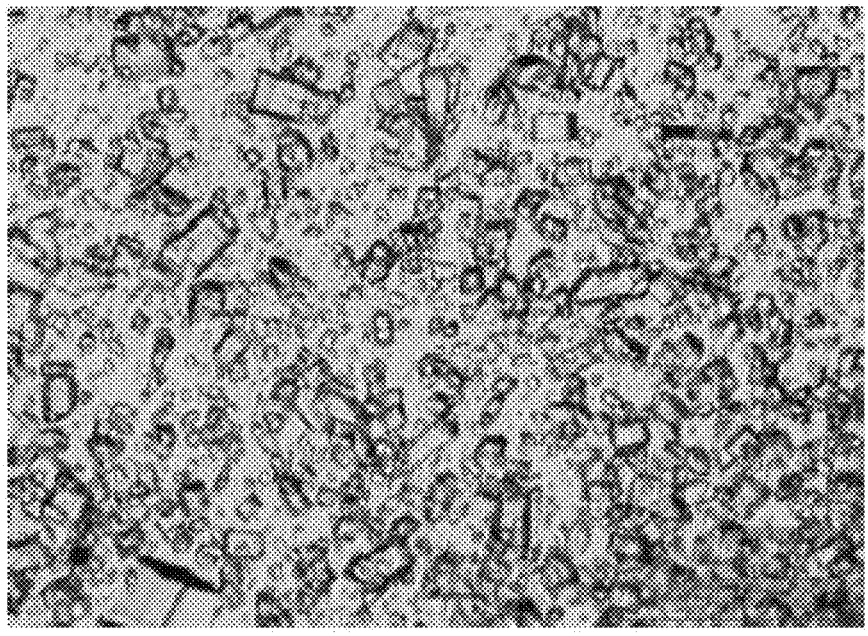
(A)
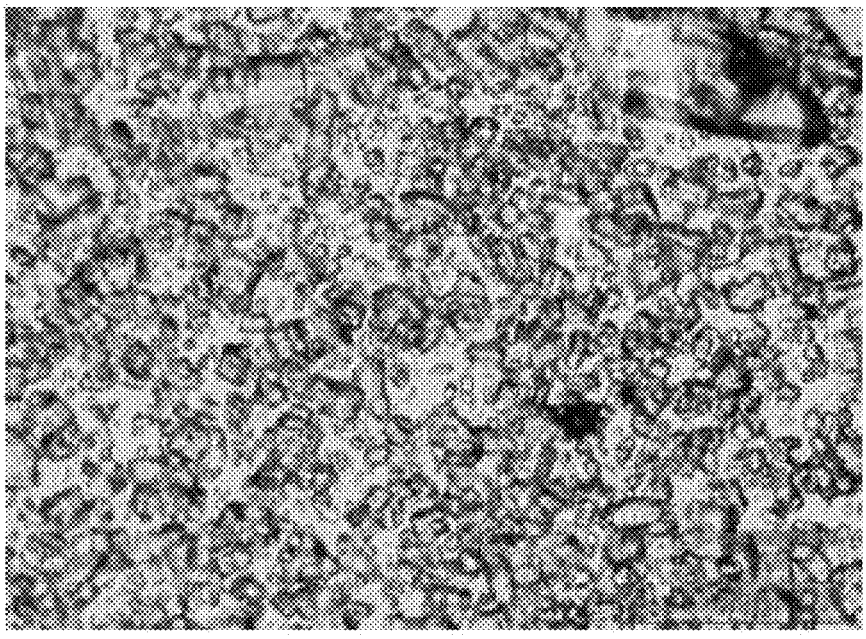
(B)

Fig. 4 Photographs with a microscope of a sucrose crystal-containing liquid
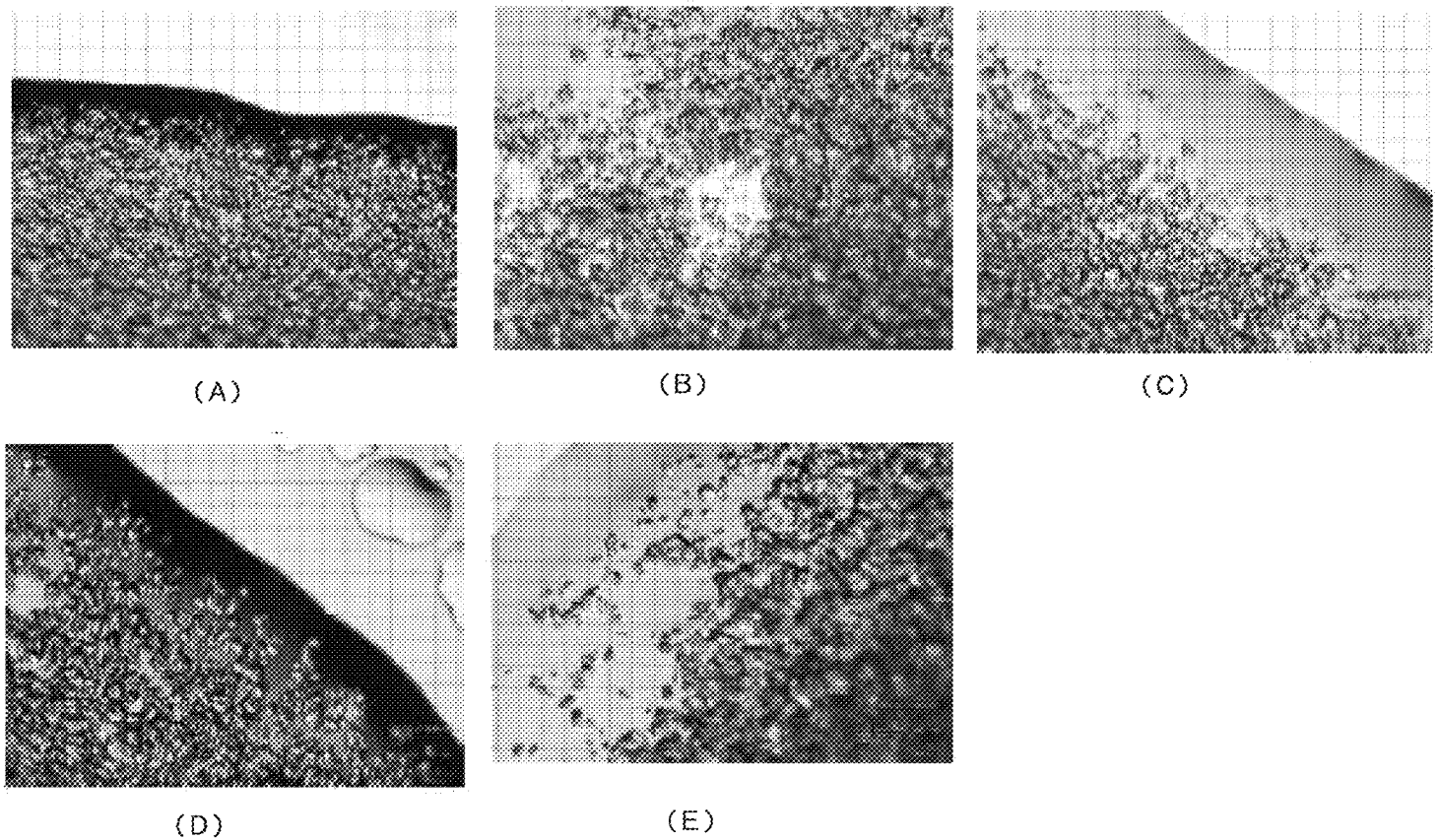

METHOD FOR PRODUCING A SUGAR CRYSTAL-CONTAINING LIQUID

FIELD OF THE INVENTION

The present invention relates to a method for producing a sugar crystal-containing liquid and, in particular, to a method for producing a sugar crystal-containing liquid by applying a shearing force to a liquid supersaturated with sugar.

BACKGROUND OF THE INVENTION

Methods for producing a sugar crystal-containing liquid generally comprise steps of preparing a liquid supersaturated with sugar, adding seed crystals to the liquid, and stirring them.

By the stirring, a shearing force is applied on the liquid to crystallize sugar. To promote the crystallization of sugar, a high stirring speed may be employed. However, when a too much high stirring speed is employed, a liquid temperature rises so that it is difficult to maintain an adequate degree of supersaturation in some cases. Besides, the rise of a liquid temperature may cause the sugar crystals to dissolve.

The seed crystals promote the crystallization of the sugar. A size, shape or amount of the seed crystals to be added affects a size, shape or the number of grains in graining. Therefore, setting of the size, shape and amount of the seed crystals to be added are important in the method for crystallizing the sugar. For Example, when the amount is too small, a sufficient amount or number of sugar crystals are not obtained in some cases.

The following Patent Literature 1 discloses "A method for producing a slurry comprising microcrystals of a saccharide or sugar alcohol, wherein the method comprises steps of producing a sugar liquid by dissolving a saccharide or sugar alcohol, which his less soluble in water at a low temperature, in high-temperature water in a high concentration; cooling the sugar liquid to a supersaturation temperature; rapidly stirring the sugar liquid; and making the sugar liquid into a laminar flow state in a predetermined time during which complete crystallization does not occur, to allow the sugar in the sugar liquid to crystallize as microcrystals" (Claim 1).

The following Patent Literature 2 discloses "A continuous crystallization method of anhydrous crystalline fructose, wherein the method comprises steps of continuously supplying a fructose solution having a fructose content of 90% or more and a solid content of 87 w/w % or more, and a crystal-containing solution of a large amount, that is, 0.5 to 5 parts relative to 1 part of the fructose solution, to a graining tower having a rapid stirrer, and rapidly mixing them at 40 degrees C. to 50 degrees C.; and continuously supplying the obtained solution mixture to a crystallization tower, and gradually cooling the solution mixture under conditions where new crystals do not spontaneously arise, so as to grow crystals" (Claim 1).

The following Patent Literature 3 discloses "A method for producing whey powder, wherein the method comprises steps of homogenizing milk sugar crystallized in advance in a whey condensed liquid by a homogenizer to crush milk sugar crystals to a size of 100 mesh or less; and then performing pressure spray drying using a nozzle atomizer" (Claim 1). The Patent Literature 3 further discloses that "when the milk sugar is crystallized in the whey condensed liquid in advance, the condensed liquid is rapidly cooled to produce microcrystals of the milk sugar" in the method of claim 1 (Claim 2).

The following Patent Literature 4 discloses "A method for producing an isomaltulose-containing solid from a sugar liquid by making an enzyme producing isomaltulose from sucrose act on a sucrose liquid to produce an isomaltulose-containing sugar liquid, wherein the method comprises steps of crystallizing isomaltulose with a median diameter of 5 to 60 μm in the sugar liquid wherein the median diameter is measured by laser diffraction particle size distribution measurement; and spray-drying the sugar liquid comprising the isomaltulose crystals at a hot air temperature of 50 to 95 degrees C." (Claim 1). The afore-mentioned crystallization of isomaltulose is carried out by adjusting a Brix of the isomaltulose-containing sugar liquid and then aging the sugar liquid (paragraph 0033).

PRIOR ART LITERATURES

Patent Literatures

Patent Literature 1: Japanese Patent Application Laid-Open No. 2012-239422

Patent Literature 2: Japanese Patent Application Laid-Open No. Sho 60-118200/1985

Patent Literature 3: Japanese Patent Application Laid-Open No. Hei 8-298927/1996

Patent Literature 4: Japanese Patent Application Laid-Open No. 2013-005790

SUMMARY OF THE INVENTION

An object of the present invention is to provide a method for producing a sugar crystal-containing liquid with good reproducibility, wherein crystallization is enhanced, it is unnecessary to add seed crystals which may affect the number of grains and a size of the crystals, and graining conditions are stable.

The present invention is a method for producing a sugar crystal-containing liquid, wherein the method comprises steps of preparing a liquid supersaturated with sugar; and applying a shearing force to the liquid, characterized in that the step of applying the shearing force comprises exerting a pressure higher than atmospheric pressure on the liquid to make the liquid pass through a narrow space. The step of applying the shearing force may preferably be carried out by a pressure homogenizer.

Effects of the Invention

In the method of the present invention, a pressure higher than atmospheric pressure is applied on the liquid to make the liquid pass through a narrow space to thereby apply a shearing force to the liquid, whereby a larger number of crystal nuclei are generated in the liquid. That is to say, the method of the present invention enhances graining. Further, the method of the present invention does not need addition of seed crystals.

Applying a pressure higher than atmospheric pressure on a liquid to make a liquid pass through a narrow space to thereby apply a shearing force has been conventionally used for emulsifying or dispersing a liquid, or pulverizing particles. This technique has not been used for graining. The present inventors have found that this technique promotes graining.

Further, rise of a temperature of the sugar liquid is suppressed in the method of the present invention. As a result, the appropriate supersaturation state of the liquid is maintained. Furthermore, dissolution of the obtained sugar crystals is suppressed.

Moreover, the time required for attaining the desired number and/or size of sugar crystals is shortened in the method of the present invention. We believe that this is because of the aforesaid promoted graining and/or the suppression of the temperature rise of the sugar liquid.

The method of the present invention is applicable to crystallization of various kinds of sugar such as isomaltulose and sucrose. The method of the present invention is applicable also to a solution containing plural kinds of sugar. Moreover, the method of the present invention is applicable also to a liquid containing crystallizable sugar and non-crystallizable sugar.

The liquid may be let to pass through a narrow space twice or more in the method of the present invention. More specifically, the liquid which was let to pass through a narrow space is stored in a tank, and then again let to pass the narrow space. The plural passes make it possible to enhance a crystallization ratio. The crystallization ratio is a percentage by weight of obtained crystals relative to a total solid content. Besides, instead of letting the liquid to pass in plural times, it is also possible to circulate the liquid between the narrow space and the tank for a predetermined time period. The particle size and the number of grains of crystal may be regulated by adjusting the number of passing or the circulation time period.

Stirring blades of a stirring apparatus receive an excessive load to cause stop or failure of the stirring apparatus in the conventional methods. In contrast, no stirring blades are used in the method of the present invention, so that stop or failure of the device is avoided.

BRIEF EXPLANATION OF THE DRAWINGS

FIG. 3 shows microphotographs of a sucrose crystal-containing liquid.

FIG. 4 shows microphotographs of a sucrose crystal-containing liquid.

EMBODIMENTS OF THE INVENTION

Figure 1:
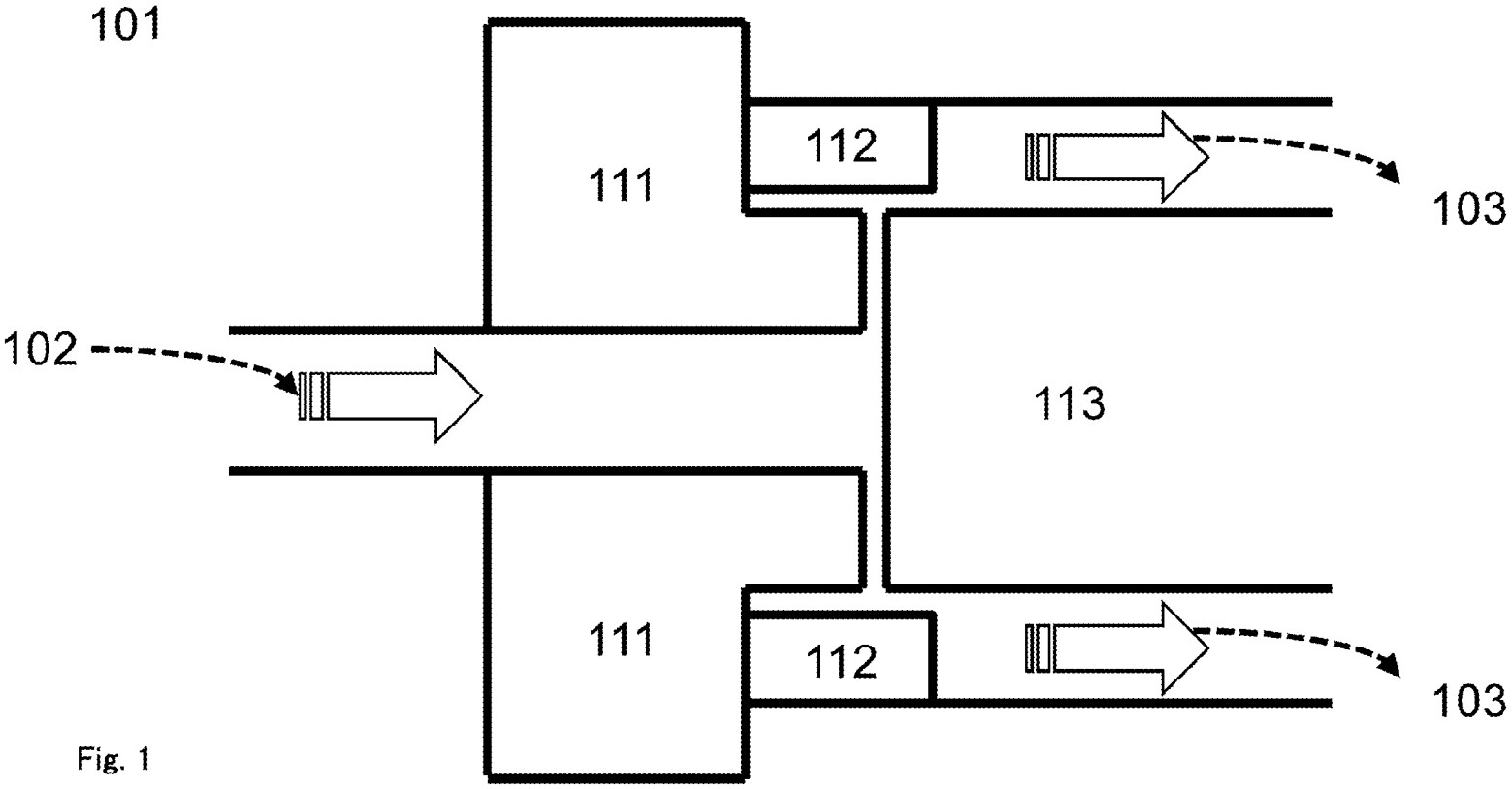
FIG. 1 is a schematic view of a narrow space portion in a shearing force application device.

In the present invention, the sugar may be any sugar as long as it can exist in a supersaturation state in a liquid and can crystallize. The sugar may be, for example, a saccharide or sugar alcohol. The saccharide may be, for example, a disaccharide such as sucrose, lactose, isomaltulose (PALATINOSE, trademark of Mitsui Sugar Co., Ltd.), and maltose, and a monosaccharide such as glucose and fructose. The sugar alcohol may be, for example, sorbitol, maltitol, xylitol, erythritol, and reduced isomaltulose (reduced PALATINOSE, trademark).

The supersaturation state in the present invention means a state in which a solution contains a solute in an amount larger than the solubility at a certain temperature.

In the present invention, a liquid supersaturated with sugar means a liquid in which sugar is dissolved in an amount larger than a solubility of the sugar at a temperature of the liquid. Plural kinds of sugar may be contained or dissolved in the liquid. For example, a liquid contains isomaltulose and trehalulose. Such a liquid containing isomaltulose and trehalulose may be, for example, a sugar liquid obtained by making an enzyme, α-glucosyltransferase, produced, for example, by *Protaminobacter rubrum, Serratia plymuthica, Erwinia rhapontici*, or *Klebsiella* sp., act on sucrose. The sugar liquid may comprise, for example, 60 to 90 mass % of isomaltulose, 5 to 35 mass % of trehalulose, and each 0.2 to 5 mass % of glucose and fructose. A method for producing the sugar liquid is disclosed, for example, in Japanese Patent Application Laid-Open No. 2013-005790.

In the present invention, the preparation of a liquid supersaturated with sugar may be done by any means. For example, a sugar solution with a Brix of 55 to 90°, particularly 56 to 88°, more particularly 57 to 85°, is prepared, and gradually cooled. The sugar solution having the aforesaid Brix may be prepared with heating or in any other manner. A preparation method of the sugar solution is disclosed, for example, in Japanese Patent Application Laid-Open No. 2013-005790. The aforesaid cooling may be carried out by any known means. The sugar solution is put, for example, in a crystallizer and a temperature of the sugar solution is gradually lowered in the crystallizer, resulting in a liquid supersaturated with sugar. The liquid supersaturated with sugar needs only to contain sugar in a supersaturation state and a part of sugar may be crystallized or solidified.

In the present invention, a shearing force is caused by applying a pressure higher than atmospheric pressure on a liquid to make the liquid pass through a narrow space. A device that applies the shearing force to the liquid is referred to as a shearing force application device in the present invention.

The narrow space means a narrow section in a flow space for the liquid in the shearing force application device. The flow velocity of the liquid is increased in the narrow space so that the shearing force is applied to the liquid. The width of the narrow space may appropriately be set by a person skilled in the art and may be, for example, 1 to 2000 μm, particularly 1 to 1000 μm, particularly 10 to 800 μm, more particularly 30 to 600 μm, and furthermore particularly 50 to 500 μm. The width means a narrow space width in a direction perpendicular to a traveling direction of the liquid. The narrow space may have, at least one position, such a width with which the shearing force is applied to the liquid, as mentioned above. If the width is too small, the space may clog. If the width is too large, the shearing force applied may be too weak, resulting in insufficient graining. The width of the narrow space may be fixed or varied depending on, particularly, a flow rate of the liquid made to pass therethrough, a pressure to be exerted, and valve shape. The narrow space is, for example, a gap between a homogenizing valve and a valve sheet (referred to as a valve gap) in a pressure homogenizer in which the width of the narrow space may be varied, where the width of the narrow space is a shortest distance between the homogenizing valve and the valve sheet. The flow rate of the liquid in the narrow space may vary, depending on, particularly, the pressure to be exerted, and the width of the narrow space.

The pressure may be a pressure exerted on the liquid at an inlet of the narrow space. The pressure is measured, for example, by a pressure gauge attached to a pressure homogenizer in which the width of the narrow space may be varied depending on a pressure and a flow rate, as will be described below. A pressure gauge in a pressure homogenizer is referred to as a homogeneous pressure gauge. The pressure may be preferably 1 to 100 MPa, more preferably 2 to 90 MPa, more preferably 3 to 80 MPa, more preferably 3 to 70 MPa, more preferably 5 to 50 MPa, and furthermore preferably 7 to 30 MPa. If the pressure is too high, the liquid temperature may excessively rise. If the pressure is too low, graining does not occur sufficiently.

In the present invention, the shearing force applied when the pressure over atmospheric pressure is exerted on the liquid to make the liquid pass through the narrow space is very strong and instantaneous. Graining is enhanced by the very strong and instantaneous shearing force. The liquid temperature is only a little raised by the application of the very strong and instantaneous shearing force. In a conventional manner of applying a shearing force by stirring, a moderate degree of shearing force is applied for several tens of seconds, for example, in a kneader. Then, the grained crystals may dissolve due to an increased liquid temperature. We believe in the present invention that besides the application of the shearing force, cavitation and/or pulverization of crystals is caused by making the liquid pass through the narrow space, exerting the pressure over atmospheric pressure on the liquid. The cavitation may occur on account of a sudden decrease in pressure on the liquid at a position rear the narrow space. The pulverization may occur because the liquid is accelerated by the pressure when passing through the narrow space, and collides against a wall inside the device at a high speed. The wall may be provided so that the liquid spouting from the narrow space collides against the wall at a high speed. For instance, the wall may be provided perpendicularly to the flow direction of the liquid in the narrow space and at any distance from a rear end of the narrow space. The distance from a rear end of the narrow space to the wall can properly be set by a person skilled in the art and may be, for example, 0.1 to 5 mm, particularly 0.3 to 4 mm, and more particularly 0.5 to 3 mm. The wall may be an impact ring in a case where the pressure homogenizer is provided with the impact ring. We believe that a synergetic effect of these actions promotes graining, namely, increases the number of newly generated crystal nuclei. We believe that growth of existing crystals is suppressed on account of the promoted graining. We also believe that the suppression of the growth of the existing crystals results in more and smaller crystals in the liquid.

The shearing force application device in the present invention may be a pressure homogenizer. The pressure homogenizer is also called a high-pressure homogenizer or an emulsifying and dispersing apparatus. In the pressure homogenizer, the width of the narrow space may be fixed or varied depending on, for instance, a flow rate of the liquid made to pass therethrough, a pressure to be exerted, and a valve shape.

Examples of the device in which the width of the narrow space is fixed include Microfluidizer (Microfluidics Corp.), Nanomizer (NANOMIZER Inc.), and Star Burst (Sugino Machine Limited). The width of the narrow space may be appropriately set by a person skilled in the art and may be, for example, more than 0 to 1000 μm or less, particularly 10 to 800 μm, more particularly 30 to 600 μm, and furthermore particularly 50 to 500 μm.

In the device in which the width of the narrow space may be varied, the liquid is made to pass through, for example, a gap between a homogenizing valve and a valve sheet. Examples of the device in which the width of the narrow space may be varied include a high-pressure homogenizer (ex Raney Co., Ltd.), a homogenizer (ex Sanwa Engineering. Co., Ltd.), Homogenizer HV-E type, HV-A type, and HV-H type (all ex Izumi Food Machinery Co., Ltd.), and Golin type Homogenizer (AVP Co., Ltd.). The width of the narrow space between a homogenizing valve and a valve sheet may be varied, depending on a flow rate of the liquid made to pass therethrough, a pressure to be exerted, and a valve shape and may be, for example, more than 0 to 1000 μm or less, particularly 10 to 800 μm, more particularly 30 to 600 μm, and furthermore particularly 50 to 500 μm.

A shape of a disk of the aforesaid homogenizing valve may be, for example, spiral, flat, sharp, or net. The spiral type is preferred from a viewpoint of durability. One or more narrow spaces may be provided in the device. The shapes of the disks of the homogenizing valves defining the narrow spaces may be the same with or different from each other. For example, A disk shape of a first homogenizing valve may be spiral and a disk shape of a second homogenizing valve may be flat in the device in which the width of the narrow space may be varied.

FIG. 1 illustrates an example of a narrow space portion in the aforesaid shearing force application device. A shearing force application device (101) in FIG. 1 is provided with a valve sheet (111) and a valve (113). Further, the shearing force application device (101) may optionally be provided with an impact ring (112) that is a consumable to prepare for wear and tear in continuous operation. The shearing force application device (101) is provided with a pressurizing mechanism and a homogenizing valve mechanism. The pressurizing mechanism creates a stable high-pressure state in a supersaturated sugar liquid (liquid supersaturated with sugar) (102), and the homogenizing valve mechanism attains the effect of homogenization. In the shearing force application device (101), the supersaturated sugar liquid (102) flows into an inside of the valve sheet (111), is pressurized and collides against the valve (113). In this event, a liquid to be treated passes through the narrow space, which is adjustable, between the valve sheet (111) and the valve (113). The flow velocity of the liquid increases, when the liquid passes through the narrow space. In a case where the shearing force application device (101) is provided with the impact ring (112), the liquid with the creased flow velocity is released from pressure and collides against the impact ring (112). In a case where no impact ring is applied, the liquid collides against a wall existing at this point. Then, the treated sugar crystal-containing liquid (103) flows toward an outlet.

In the present invention, the temperature of the liquid at the time of the shear treatment is appropriately set depending on a solubility of sugar and a degree of supersaturation of sugar. If the temperature is too high, a proper degree of supersaturation cannot be maintained. If the temperature is too low, the sugar liquid may cake. A person skilled in the art may properly decide a temperature at which a proper degree of supersaturation is maintained and caking of the sugar liquid is avoided. In the case of the aforesaid sugar liquid obtained by making the enzyme, α-glucosyltransferase, act on sucrose and the case of a sucrose solution, the aforesaid temperature may be, for example, 10 to 50 degrees C., preferably 12 to 48 degrees C., and more preferably 15 to 45 degrees C.

In the present invention, the aforesaid shear treatment may be carried out on the whole or a part of the liquid supersaturated with sugar. Even when the aforesaid shear treatment is carried out on a part of the liquid supersaturated with sugar and the treated liquid is mixed with the remaining liquid, generation of crystal nuclei is promoted. A half amount to the whole amount of the volume of the liquid supersaturated with sugar may be made to pass through a homogenizing valve gap.

A sugar crystallization ratio of a sugar crystal-containing liquid in the present invention may be appropriately adjusted depending on use of the liquid. The crystallization ratio is percentage by mass of sugar crystals, relative to a total weight of sugar in the sugar crystal-containing liquid. The lower limit of the crystallization ratio may be, for example, 10%, 20%, 30%, or 40%. The upper limit of the crystallization ratio may be, for example, 80%, 70%, or 60%. A range of the crystallization ratio may be, for example, 10 to 70%, particularly 20 to 60%. The crystallization ratio suitable for spray drying described below is preferably 30 to 50%, and more preferably 35 to 45%. The crystallization ratio is determined by putting 1 g of liquid containing crystals in a 1.5 ml Eppendorf tube, centrifuging it for 1 minute at 16,000 rpm by a centrifugal separator (M150IV, ex Sakuma Manufacturing Co., Ltd.), measuring a Brix of a supernatant. The crystallization ratio is calculated by the following Equations.

In the following Equations, A, B, S, M and X represent the following.

A: whole amount in gram

B: weight of crystals, anhydrous, in gram

S: sugar content of a liquid supersaturated with sugar before the homogenizer treatment, mass/mass %

M: Brix of a supernatant after centrifugation, ° or degree

X: crystallization ratio, %

Crystallization Ratio of Isomaltulose $$A\times S/100=(A-1.05\times B)\times M/100+B$$ (here, the amount of water of crystallization is assumed as 5%) (1a) Mathematical relational of weight of crystals $$X=B/(A\times S/100)\times 100$$ (2a) Crystallization ratio Formulas, (1a) and (2a), are combined to eliminate the unmeasurable parameter, B, resulting in the following equation.

$$X=(S-M)/S(100-1.05M)\times 10000$$

Crystallization Ratio of Sugar $$A\times S/100=(A-1.0\times B)\times M/100+B$$ (here, it is noted that sugar crystals are anhydrous.) (1b) Mathematical relational of weight of crystals $$X=B/(A\times S/100)\times 100$$ (2b) Crystallization ratio Formulas, (1b) and (2b), are combined to eliminate the unmeasurable parameter, B, resulting in the following equation.

$$X=(S-M)/S(100-M)\times 10000$$

For a crystallization ratio of other sugar, the above equations are applied, depending on how much water of crystallization is or the crystal is anhydrous.

A viscosity of the sugar crystal-containing liquid in the present invention is preferably such as to allow spray drying by a spray dryer or by a high-pressure pump. The viscosity may appropriately be adjusted, depending on the type of a spray dryer or a high-pressure pump used.

The sugar crystal-containing liquid obtained by the method of the present invention can be solidified, in particular, in a form of powder, for example, by spray drying. The method of spray drying is described, for example, in Japanese Patent Application Laid-Open No. 2013-005790.

The sugar crystals in the sugar crystal-containing liquid in the present invention have a median diameter preferably of 0.1 to 60 μm, more preferably 0.5 to 55 μm, and furthermore preferably 1 to 50 μm. The median diameter may be measured by laser diffraction particle size distribution measurement. For the measurement, SALD-2000J, ex Shimadzu Corporation, may be used. With the aforesaid median diameter, the solidification, in particular in a form of powder, of the liquid may be achieved by the spray drying as described in, for example, Japanese Patent Application Laid-Open No. 2013-005790. If the median diameter is larger than the aforesaid range, crystals and a non-crystalline sugar liquid in the liquid separate from each even after the spray drying, so that the non-crystalline sugar liquid is not enveloped with the sugar crystals and the crystals are surrounded by the non-crystalline sugar liquid in a product obtained by the spray drying. The obtained product is thus highly hygroscopic and extremely sticky, or caked.

The present invention will be further explained below with reference to the Examples, but the present invention is not limited by those Examples.

In the following Examples, the Brix was measured by a digital refractometer, RX-5000 ex Atago Co., Ltd.

In the following Examples, the particle size is the median diameter. The particle size was measured by a laser diffraction particle size distribution measuring instrument (Shimadzu Corporation, SALD-2000J).

Example 1

An isomaltulose-containing sugar liquid was obtained by making α-glucosyltransferase obtained from *Protaminobacter rubrum* to act on a 40 mass % sucrose liquid, and then was desalted. The enzyme reaction and the desalting were carried out according to the method described in "Manufacture and Utilization of Palatinose," Yoshikazu NAKAJIMA, Den-pun Kagaku (or Starch Science), Journal of the Japanese Society of Starch Science, 1982, Vol. 35, No. 2, pp 131-139. The Brix of this desalted liquid was 38.2°. Table 1 shows the sugar composition of the desalted liquid.

TABLE 1

Sugar composition of a Desalted liquid, mass %

| PALATINOSE | TREHALULOSE | FRUCTOSE | GLUCOSE | SUCROSE | OTHERS |
|---|---|---|---|---|---|
| 83.6 | 10.8 | 2.2 | 1.9 | 1.5 | 0 |

The desalted liquid was put in a 10-liter flask of a rotary evaporator, N-11 ex TOKYO RIKAKIKAI CO, LTD, equipped with a cooling trap, UT-50 type, ex TOKYO RIKAKIKAI CO, LTD, and a diaphragm type vacuum pump, DIVAC 2.2L ex TOKYO RIKAKIKAI CO, LTD, and heated at 85 degrees C. to obtain a liquid condensate so as to have a Brix of 65°. The liquid condensate was taken in a stainless steel can and gradually cooled to degrees C., whereby a liquid supersaturated with isomaltulose was obtained. It was determined by the Brix and the temperature of the liquid condensate and the solubility of isomaltulose at the temperature whether the liquid was in a supersaturation state or not. The liquid supersaturated with isomaltulose was treated by a pressure homogenizer, HV-0H-06-3.7SS, ex Izumi Food Machinery Co., Ltd. with a homogenizing pressure of 30 MPa, 60 MPa or 75 MPa at a flow rate of 100 to 120 L/Hr. The homogenizing pressure was measured by a pressure gauge provided between a cylinder block outlet and a homogenizing valve. The liquid temperature of the isomaltulose solution at the time when put in the homogenizer was 30 degrees C. The homogenizer had two homogenizing valves, namely, two narrow spaces through which the liquid was made to pass by exertion of a pressure higher than atmospheric pressure thereon. The width of the narrow space could be varied by an applied pressure, but was about 100 μm for all of the applied pressures. The homogenizing disks constituting the homogenizing valves were a spiral type disk and a flat type disk, respectively. The aforesaid solution in a supersaturation state was made to pass once through each of the valve gaps of the two homogenizing valves for the pressure homogenizer treatment. As a result, an isomaltulose crystal-containing liquid was obtained.

The temperatures of the isomaltulose crystal-containing liquids after the aforesaid treatment were 33.4 degrees C., 40.5 degrees C., and 44.4 degrees C. when the applied homogenizing pressures were 30 MPa, 60 MPa and 75 MPa, respectively. In other words, the temperature rises were 3.4 degrees C., 10.5 degrees C., and 14.4 degrees C., respectively.

Example 2

A liquid condensate was obtained according to the method described in Example 1 except that the Brix was adjusted to 69°. The liquid condensate was taken in a stainless steel can and gradually cooled to 40 degrees C. to obtain a liquid supersaturated with isomaltulose was obtained. The homogenizer treatment was carried out on the liquid supersaturated with isomaltulose, as in Example 1 except that the applied homogenizing pressure was 10, 15, 20, 30, 40, 50, 60 or 75 MPa. As a result, isomaltulose crystal-containing liquids were obtained in all of the cases of the various homogenizing pressures.

The temperatures of the isomaltulose crystal-containing liquids after the aforesaid treatment were 34, 34.5, 36, 39, 44, 44.5, 46 and 48 degrees C. when the applied homogenizing pressures were 10, 15, 20, 30, 40, 50, 60 and 75 MPa, respectively. Thus, the temperature changes were −6 degrees C., −5.5 degrees C., −4 degrees C., −1 degrees C., +4 degrees C., +4.5 degrees C., +6 degrees C., and +8 degrees C., respectively.

Example 3

Figure 2:
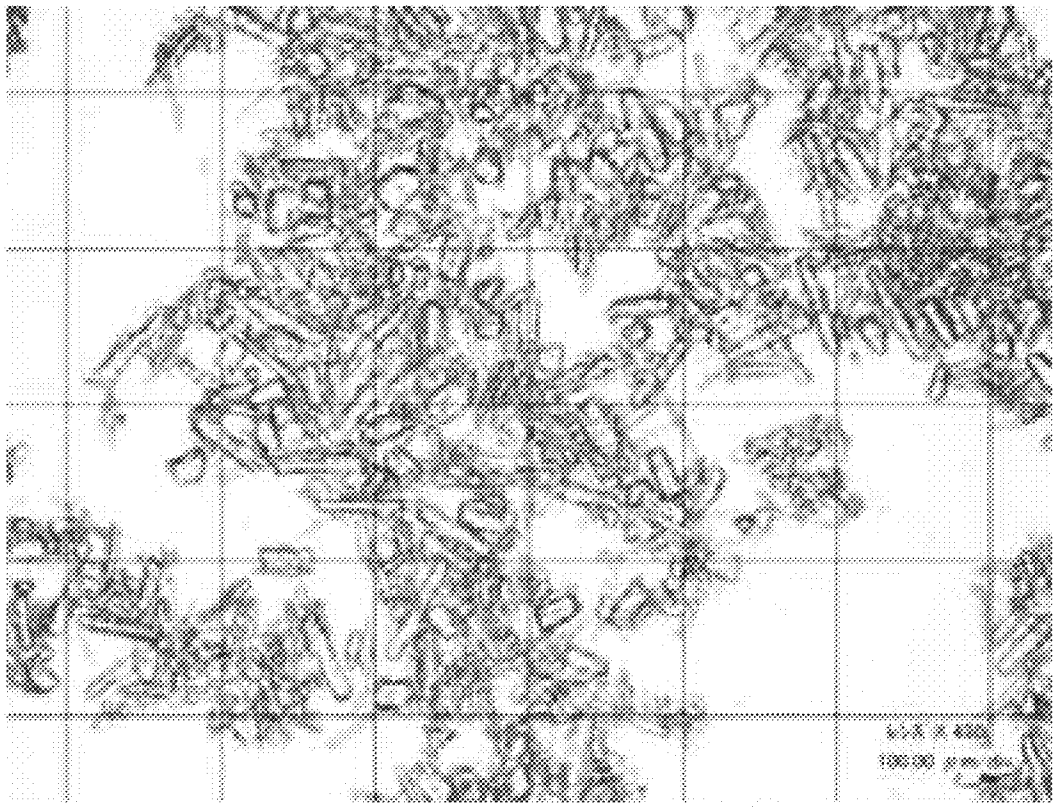
FIG. 2 shows a microphotograph of an isomaltulose crystal-containing liquid.

A liquid supersaturated with isomaltulose was obtained according to the method described in Example 1. The homogenizer treatment was carried out on the liquid in a supersaturation state, as described in Example 1 except that the applied homogenizing pressure was 10, 20, 30, 40, 50, 60 or 70 MPa. The liquid temperature of the isomaltulose solution when put in the homogenizer was 31 degrees C. As a result, an isomaltulose crystal-containing liquid was obtained in all of the cases of the various homogenizing pressures. FIG. 2 shows a microphotograph at ×450 of the isomaltulose crystal-containing liquid obtained in the case of the homogenizing pressure of 30 MPa. The size of the mesh in FIG. 2 is 100 μm. As seen in FIG. 2, the crystals contained in the liquid were acicular with a length in the longitudinal direction of the crystals of less than 100 μm, mostly 60 μm or less.

The temperatures of the aforesaid isomaltulose crystal-containing liquid after the aforesaid treatment were 31.5, 32, 33.5, 35.2, 37.8, 40.6 and 43 degrees C. when the applied homogenizing pressures were 10, 20, 30, 40, 50, 60 and 70 MPa, respectively. Thus, the temperature rises were 0.5 degree C., 1 degree C., 2.5 degrees C., 4.2 degrees C., 6.8 degrees C., 9.6 degrees C., and 12 degrees C., respectively.

Comparative Example 1

A liquid supersaturated with isomaltulose was obtained according to the method described in Example 1. The homogenizer treatment was carried out on the liquid in a supersaturation state as described in Example 1 except that the homogenizing pressure was not applied. The liquid temperature of the isomaltulose solution when put in the homogenizer was 31 degrees C. A sugar crystal-containing liquid obtained by the homogenizer treatment contained many crystals of about 100 μm or larger. We believe that this is because the number of grain crystals is small, so that crystals which already existed grew larger. The liquid temperature of the sugar crystal-containing liquid was 25.6 degrees C.

Example 4

A liquid condensate was obtained according to the method described in Example 1 except that the Brix was adjusted to 61°. The liquid condensate was taken in a stainless steel can and gradually cooled to 30 degrees C. to obtain a liquid supersaturated with isomaltulose. The liquid in a supersaturation state was treated, using the pressure homogenizer as described in Example 1. The applied homogenizing pressure was 20 MPa. The mode of the treatment was such that the liquid condensate was made to pass through the valve gaps of the two homogenizing valves (with a spiral type in a first stage and a flat type in a second stage) in the frequency of once to six times, or to circulate mode for 25 to 54 minutes. In the circulation mode, the liquid treated by the pressure homogenizer was returned to the stainless steel can via a circulation conduit, and then sent to the pressure homogenizer to receive the homogenizer treatment. In all of these treatment modes, the isomaltulose crystal-containing liquid was obtained. In all of these treatment modes, no clogging occurred in the homogenizing valves, and neither stop nor failure of the device occurred.

Table 2 shows the liquid temperature of the isomaltulose crystal-containing liquid obtained in each of the treatment modes.

TABLE 2

Liquid temperature of the sugar crystal-containing liquid obtained in the treatment

| TREATMENT MODE | LIQUID TEMPERATURE AFTER TREATMENT, degrees C. |
|---|---|
| 1 PASS | 29.9 |
| 2 PASS | 31.9 |
| 3 PASS | 33.1 |
| 4 PASS | 34.5 |
| 5 PASS | 35.4 |
| 6 PASS | 36.3 |
| 25 MINUTE CIRCULATION | 38.1 |
| 28 MINUTE CIRCULATION | 39.4 |
| 30 MINUTE CIRCULATION | 40.2 |
| 33 MINUTE CIRCULATION | 40.9 |
| 39 MINUTE CIRCULATION | 42.3 |
| 54 MINUTE CIRCULATION | 44 |

As seen from Table 2, the liquid temperature rose with the increased number of pass through the valve gap or with the increased circulation time. An increasing effect of pulverization (namely, the increased number of grains) is attained with the increased number of the times of pass.

Even in a case where seed crystals were added in the treatment, the isomaltulose crystal-containing liquid was obtained.

Example 5

Sucrose (granulated sugar, ex Mitsui Sugar Co., Ltd.) was added to water and heated to about 70 to 80 degrees C. to obtain a sucrose solution having a Brix of 76°. The temperature of the solution was gradually cooled to 40 degrees C. to obtain a sucrose solution in a supersaturation state. The solution was cloudy. That is, a part of sucrose was crystallized, by which the supersaturation state was confirmed. The liquid in the supersaturation state was subjected to the circulation mode treatment by a pressure homogenizer, HV-0H-06-3.7SS, ex Izumi Food Machinery Co., Ltd.) for one hour with a homogenizing pressure of 20 MPa and a flow rate of 100 L/Hr. The circulation mode treatment was as described in Example 4. The homogenizer had two homogenizing valves. The homogenizing disks constituting the homogenizing valves were of a spiral type and a flat type, respectively. As a result of the treatment, a sucrose crystal-containing liquid was obtained.

In the aforesaid treatment, the crystallization ratio of the sucrose crystals increased with a lapse of the treatment time. The increase of the crystallization ratio of the sucrose crystals became stable when the crystallization ratio reached about 32.0% 50 minutes after the start of the treatment. The viscosity of the sucrose crystal-containing liquid 50 minutes after start of the treatment was 330 mPa·s.

FIG. 3 shows microphotographs at ×450 with a microscope, VHX-200, ex Keyence Corporation, on the sucrose crystal-containing liquid at 10 minutes (A) and 50 minutes (B) after the start of the treatment. The crystallization ratios of the sucrose crystals were 15.9% and 32.0% 10 minutes and 50 minutes (end of the treatment) after the start of the treatment, respectively. In FIG. 3, sucrose crystals in the liquid can be confirmed.

Example 6

Sucrose solutions were obtained according to the method described in Example 5. Four solutions with Brixes of 74°, 76°, 78°, or 80° were provided. The solution with a Brix of 74° was gradually cooled to 20 degrees C. into a supersaturation state; and the solutions with Brixes of 76°, 78°, or 80° were gradually cooled to 40 degrees C. into a supersaturation state. The four solutions in a supersaturation state were treated by the pressure homogenizer described in Example 1 with a homogenizing pressure of 20 MPa at a flow rate of 120 L/Hr. The homogenizing disks used in the homogenizer were same as those described in Example 1. The circulating mode of treatment was carried out on the solutions with Brixes of 74°, 76°, 78°, or 80° for 70 minutes, 75 minutes, 90 minutes and 40 minutes, respectively. As a result, sucrose crystal-containing liquids were obtained.

The crystallization ratio was determined for each of the four solutions. Further, after the completion of the treatment, the liquids were kept at 45 degrees C. The crystallization ratios at 880, 115, 130 and 880 minutes were determined. Table 3 shows the crystallization ratios. In Table 3, "less crystallization" means that a crystallization ratio could not be determined (namely, separation by a centrifugal was impossible) and the liquid was becoming cloudy. The symbol "-" in Table 3 means no data (not measured).

TABLE 3

Crystallization ratio and the liquid temperature with each Brix

| Brix (°) | MEASUREMENT TIME, min. | CRYSTALLIZATION RATIO, % |
|---|---|---|
| 74 | 0 | — |
| | 70 | LESS CRYSTALLIZATION |
| | 880 | 21.1 |

TABLE 3-continued

Crystallization ratio and the liquid temperature with each Brix

| Brix (°) | MEASUREMENT TIME, min. | CRYSTALLIZATION RATIO, % |
|---|---|---|
| 76 | 0 | — |
| | 30 | 3.7 |
| | 45 | 22.3 |
| | 60 | 26.3 |
| | 75 | 27.4 |
| | 115 | 25.3 |
| 78 | 0 | — |
| | 30 | 27.1 |
| | 45 | 32.6 |
| | 60 | 34.2 |
| | 75 | 37.2 |
| | 90 | 36.6 |
| | 130 | 34.5 |
| 80 | 0 | — |
| | 10 | 36 |
| | 20 | 40 |
| | 30 | 43 |
| | 40 | 42.5 |
| | 880 | 43.3 |

As seen from Table 3, sucrose crystals were formed with all of the Brixes. In the case where the Brix was 80° and the liquid temperature was 40 degrees C., the time for the crystallization ratio to reach the maximum was shortest and the crystallization ratio was highest.

FIG. 4 shows microphotographs at ×450 with a microscope, VHX-200, ex Keyence Corporation, on the sucrose crystal-containing liquid 10 minutes (A), 20 minutes (B), 30 minutes (C), 40 minutes (D) and 880 minutes (E) after the start of the treatment where the Brix was 80° and the liquid temperature was 40 degrees C. In FIG. 4, sucrose crystals in the liquid can be confirmed.

Example 7

A sucrose solution with a Brix of 78° was obtained according to the method described in Example 6. The solution was gradually cooled to 40 degrees C. or 30 degrees C. into a supersaturation state. These two solutions in a supersaturation state were treated by the pressure homogenizer described in Example 1 with a homogenizing pressure of 20 MPa at a flow rate of 120 L/Hr. The homogenizing disks used in the homogenizer were same as those described in Example 1. The circulating mode treatment was carried out for 75 minutes or 60 minutes, respectively. For the solution cooled to 40 degrees C., a thermal insulation tank was provided in a circulation path in the circulation treatment. In the thermal insulation tank, two stirring blades were operated for stirring. As a result of the homogenizer treatment, sucrose crystal-containing liquids were obtained.

The crystallization ratio was determined for each of the two solutions. Table 4 shows the crystallization ratios.

TABLE 4

Crystallization ratio and liquid temperature at each saturated solution temperature

| TEMPERATURE OF THE SATURATED AQUEOUS SOLUTION | TIME OF SAMPLING, min. | CRYSTALLIZATION RATIO |
|---|---|---|
| 40 degrees C. | 0 | — |
| | 30 | 24.5 |
| | 45 | 31.3 |
| | 60 | 35.1 |
| | 75 | 33.6 |

TABLE 4-continued

| Crystallization ratio and liquid temperature at each saturated solution temperature | | |
|---|---|---|
| TEMPERATURE OF THE SATURATED AQUEOUS SOLUTION | TIME OF SAMPLING, min. | CRYSTALLIZATION RATIO |
| 30 degrees C. | 0 | — |
| | 30 | 33.9 |
| | 45 | 36.6 |
| | 60 | 36.9 |

As seen in Table 4, in the case of 40 degrees C., the crystallization ratio increased with a lapse of the treatment time, but decreased at 75 minute. We believe that the decrease is because the crystals dissolved due to the rise of liquid temperature in the homogenizer treatment. In the case of 30 degrees C., the increase of the crystallization ratio seemed to stop at 45 minute and, therefore, the homogenizer treatment was ended at 60 minute.

Comparative Example 2: Kneader Treatment

A desalted liquid was obtained according to the method described in Example 1. The desalted liquid was heated to obtain liquid condensates with a Brix of 61°, 63°, 65°, 67°, or 69°. The liquid condensate with a Brix of 61° was cooled to 15 degrees C. into a supersaturation state. Each of the liquid condensates with Brixes of 63°, 65°, and 67° was cooled to 30 degrees C. into a supersaturation state. The liquid condensate with a Brix of 69° was cooled to 40 degrees C. into a supersaturation state. Each of the liquid condensate in a supersaturation state was subjected to a shear treatment by two kneaders, S1KRC Kneader with a nominal dimension of ϕ25×255 L (L/D=10.2), ex Kurimoto, Ltd., or a kneader, KRC Hybrid Reactor, ex Kurimoto, Ltd. The number of rotation was 320 $min^{-1}$ and 130 $min^{-1}$, respectively. The liquid temperatures during the treatment were maintained at the afore-said cooling temperatures. With all of the Brixes and kneaders, crystals larger than 100 μm were found in the liquid. We believe that this is because the number of the grains was too small and, therefore, the crystals which already existed grew. In other words, the number of grains in the obtained sugar liquid was too small.

Comparative Example 3: Emulder Treatment

A desalted liquid was obtained according to the method described in Example 1. The desalted liquid was heated to obtain a liquid condensate with a Brix of 61°. The liquid condensate was cooled to 30 degrees C. into a supersaturation state. The liquid in a supersaturation state was subjected to a shear treatment by an emulder, EB-1010 ex Izumi Food Machinery Co., Ltd. or a hi-emulder, SPVE 22-1405 ex Izumi Food Machinery Co., Ltd. The number of rotations of the emulder in the shear treatment was set to 3600 or 1800. The number of rotation of the hi-emulder was set to 3600. The liquid was made to pass through a homogenizing part of the emulder once, twice or five times, or was circulated for 3 minutes. Similarly, the liquid was made to pass through a homogenizing part of the hi-emulder once, or was circulated for 2.5 minutes. In all of the cases, crystals larger than 100 μm were found in the liquid. We believe that this is because the number of the grained crystals was too small and, therefore, the crystals which already existed grew. In other words, the number of grains in the obtained sugar liquid was too small.

Table 5 shows the number of rotation of the emulder, the number of pass or the circulation time, the throughput, the liquid temperature at input, and the liquid temperature at the outlet in the shear treatment. Table 6 similarly shows the number of rotation of the hi-emulder, the number of pass or the circulation time, the throughput, the liquid temperature at input, and the liquid temperature at the outlet in the shear treatment.

TABLE 5

| Operation Conditions of the Emulder and the Liquid Temperature after the Treatment | | | | |
|---|---|---|---|---|
| NUMBER OF ROTATION OF EMULDER, rpm | NUMBER OF PASSING TIME OR CIRCULATION TIME | ACTUAL THROUGHPUT, L/Hr | LIQUID TEMPERATURE AT INPUT, degrees C. | OUTLET TEMPERATURE, degrees C. |
| 1800 or 30 Hz | 1 PASS | ABOUT 500 | 29.2 | 30.6 |
| | 2 PASS | ABOUT 500 | 29.2 | 31.6 |
| | 5 PASS | ABOUT 500 | 29.2 | 34 |
| 3600 or 60 Hz | 1 PASS | ABOUT 500 | 28.1 | 34.1 |
| | 2 PASS | ABOUT 500 | 28.1 | 38.3 |
| | 5 PASS | ABOUT 500 | 28.1 | 49.2 |
| | 3 MINUTE CIRCULATION | ABOUT 500 | 28 | 40 |

TABLE 6

| Operation Conditions of the Hi-Emulder and the Liquid Temperature after the Treatment | | | | |
|---|---|---|---|---|
| NUMBER OF ROTATION OF HI-EMULDER, rpm | NUMBER OF PASSING TIMES OR CIRCULATION TIME | ACTUAL THROUGHPUT L/Hr | LIQUID TEMPERATURE AT INPUT, degrees C. | OUTLET TEMPERATURE degrees C. |
| 3600 or 60 Hz | 1 PASS | 2400 | 28 | 30.9 |
| | 2.5 MINUTES CIRCULATION | 3600 | 30 | 40.6 |

As seen in Table 5, the temperature rise from the liquid temperature at input to the outlet temperature was small in the emulder treatment at 1800 rpm. However, no graining occurred. Then, the shearing force was intensified by increasing the number of rotation to 3600 rpm, but no graining occurred again. In the case of 3600 rpm, the temperature rise from the liquid temperature at input to the outlet temperature was large. We believe that the reason why no crystallization occurred is that the shearing force was too weak and the supersaturation state could not properly be maintained due to the rise of the liquid temperature. As shown in Table 6, no graining occurred in the case of the hi-emulder, either.

Comparative Example 4: Homomixer Treatment

A desalted liquid was obtained according to the method described in Example 1. The desalted liquid was heated to obtain a liquid condensate with a Brix of 61°. The liquid condensate was cooled to 30 degrees C. into a supersaturation state and subjected to a shear treatment by a homomixer, COMBIMIX (trademark) 3M-5, ex PRIMIX Corporation or a homomixer, ROBOMIX (trademark), ex PRIMIX Corporation. The number of rotation in the shear treatment was 12,000 rpm for both of the homomixers.

In the treatment by the homomixer, COMBIMIX (trademark) 3M-5, no crystal formed. Even with the liquid condensate of Brix of 63°, no crystal was formed.

In the treatment by the homomixer, ROBOMIX (trademark), crystals were formed, but the effect of graining was too little and the number of grains was too small, resulting in larger crystals. Thus, the graining was insufficient. The device stopped at about 50 seconds or 80 seconds (in multiple operations) after the start of the treatment. We believe that this stopping is because the sugar liquid adhered to a mechanical seal portion to apply an excessive load on the device.

EXPLANATION OF THE NUMERALS IN FIG. 1

101: shearing force application device
102: supersaturated sugar liquid
103: sugar crystal-containing liquid
111: valve sheet
112: impact ring
113: valve

The invention claimed is:

1. A method for producing a sugar crystal-containing liquid, the method comprising steps of:

preparing a liquid supersaturated with sugar; and applying a shearing force to the liquid, wherein the step of applying the shearing force comprises exerting a pressure higher than atmospheric pressure on the liquid to make the liquid pass through a narrow space, the temperature of the liquid at the time of the shear treatment being 10 to 50° C.

2. The method according to claim 1, wherein the step of applying the shearing force is carried out by a pressure homogenizer.

3. The method according to claim 1 or 2, wherein the pressure is 1 MPa to 100 MPa.

4. The method according to claim 3, wherein the pressure is 7 MPa to 30 MPa.

* * * * *